US012543869B2

(12) United States Patent
Pockras

(10) Patent No.: US 12,543,869 B2
(45) Date of Patent: Feb. 10, 2026

(54) AUTO-SHELF DISPLAY STAND

(71) Applicant: Laurence M. Pockras, Franklin, OH (US)

(72) Inventor: Laurence M. Pockras, Franklin, OH (US)

( * ) Notice: Subject to any disclaimer, the term of this patent is extended or adjusted under 35 U.S.C. 154(b) by 0 days.

(21) Appl. No.: 18/680,201

(22) Filed: May 31, 2024

(65) Prior Publication Data

US 2025/0366635 A1 Dec. 4, 2025

(51) Int. Cl.
*A47F 5/11* (2006.01)

(52) U.S. Cl.
CPC ..... *A47F 5/116* (2013.01); *A47F 5/114* (2013.01)

(58) Field of Classification Search
CPC ..... A47F 5/116; A47F 5/114; A47F 5/112; A47B 43/02; A47B 55/06; A47B 47/06; A47B 87/0207
USPC ..... 211/149, 72, 135
See application file for complete search history.

(56) References Cited

U.S. PATENT DOCUMENTS 2,220,076 A 11/1940 Carruth
3,089,632 A * 5/1963 Bartolucci ..... B65D 5/4204 229/161
3,258,191 A 6/1966 Mueller et al.
3,300,166 A * 1/1967 Wojciechowski ... B65D 5/4283 229/120.32
3,529,763 A 9/1970 Wagner
3,685,775 A * 8/1972 Fortunato ..... B65D 5/5009 248/174
3,721,413 A 3/1973 Robinson
3,877,396 A * 4/1975 Patterson ..... A47F 5/116 211/186
4,182,244 A * 1/1980 Hutchins, Jr. ..... A47F 5/116 D6/675.1
4,318,474 A * 3/1982 Hasegawa ..... B65D 5/4608 206/199
4,506,790 A * 3/1985 Muscari ..... A47F 5/116 211/59.4
4,519,319 A * 5/1985 Howlett ..... A47F 5/116 108/180
4,618,115 A * 10/1986 Belokin, Jr. ..... A47F 5/116 248/174
4,630,740 A * 12/1986 Belokin, Jr. ..... A47F 5/116 248/174
4,678,088 A 7/1987 Flum
(Continued)

*Primary Examiner* — Jennifer E. Novosad
(74) *Attorney, Agent, or Firm* — Ronald J. Richter; Nesbitt IP LLC

(57) ABSTRACT

A collapsible display stand has a base section and a top section which can be stacked in the form of a tower, each section having four serially connected panels and at least one shelving assembly which is formed upon set-up. The base section can include four single window panels, each window having a foldable shelving flap which can overlap with the other shelving flaps to create a base section shelving assembly upon set up. The top section can include double window panels, each double window having a foldable shelving flap which can overlap with the other shelving flaps to form middle and top shelving assemblies upon set up. During set up, the display stand can be transformed to a standing, upright position from a flat, collapsed position, the flat, collapsed position including the base section being folded and collapsed into a standard Knock Down Flat (KDF) pallet posture.

10 Claims, 8 Drawing Sheets

(56) References Cited

U.S. PATENT DOCUMENTS 4,854,246 A * 8/1989 Belokin ..... A47F 5/116 108/162
5,042,651 A * 8/1991 Davis ..... A47F 5/116 493/90
5,060,790 A * 10/1991 Kindelberger ..... A47F 5/114 211/132.1
5,183,166 A * 2/1993 Belokin, Jr. ..... A47F 5/116 211/130.1
5,322,172 A * 6/1994 Maglione ..... A47F 5/116 211/132.1
5,335,593 A * 8/1994 Stoddard ..... A47F 5/116 100/165
5,443,168 A 8/1995 Dyment et al.
5,520,284 A 5/1996 Gray
5,758,783 A * 6/1998 Maglione ..... A47B 87/0207 211/126.2
5,887,782 A 3/1999 Mueller
6,029,885 A 2/2000 Mueller
6,149,052 A 11/2000 Mueller
6,530,516 B1 3/2003 Ritter
6,837,378 B2 * 1/2005 Mason ..... A47F 5/112 206/745
7,607,566 B2 * 10/2009 Philips ..... B65D 5/10 229/242
7,798,317 B2 9/2010 Justice et al.
8,099,883 B2 * 1/2012 Mestres Armengol ..... A47F 5/112 40/606.12
8,136,678 B2 * 3/2012 Moss ..... A47F 5/112 211/73
8,167,255 B2 * 5/2012 Tzuo ..... G09F 1/065 211/149
8,627,585 B2 * 1/2014 Herman Baran ..... A47B 97/00 108/165
8,651,298 B2 2/2014 Beaty
8,857,633 B2 10/2014 Dewhurst
9,345,345 B2 5/2016 Kula
9,580,201 B2 * 2/2017 Willman ..... B65D 5/0015
9,776,760 B2 * 10/2017 Keeder ..... B31B 50/81
9,918,569 B1 * 3/2018 Abel ..... B65D 5/5213
9,965,980 B2 * 5/2018 López ..... A47F 5/11
10,117,529 B2 * 11/2018 Abel ..... A47F 5/116
10,239,650 B2 * 3/2019 Jacomelli ..... B65D 5/0227
10,448,757 B2 * 10/2019 Urban ..... A47F 5/116
10,448,758 B1 * 10/2019 Abel ..... A47B 43/02
10,524,589 B2 1/2020 Donegan
10,568,422 B2 2/2020 Gibbons, Jr. et al.
10,617,233 B2 * 4/2020 Ertl ..... B65D 21/086
10,750,866 B2 * 8/2020 Grupenhof ..... A47F 5/116
10,888,180 B2 1/2021 Robinson
11,033,120 B2 6/2021 Frost
11,312,525 B2 * 4/2022 Sharon ..... B65D 5/029
11,470,988 B2 * 10/2022 Sharon ..... B65D 5/52
11,751,701 B2 * 9/2023 Shaffer ..... A47B 55/06 211/135
12,145,779 B2 * 11/2024 Martinsen ..... B65D 5/003
2003/0146126 A1 * 8/2003 Kanter ..... B65D 5/001 206/503
2008/0000955 A1 1/2008 Phan
2014/0014606 A1 * 1/2014 Mestres Armengol ... A47F 5/11 211/135
2016/0130030 A1 5/2016 Schropp et al.
2018/0160825 A1 * 6/2018 Abel ..... B65D 5/5213

* cited by examiner

AUTO-SHELF DISPLAY STAND

FIELD OF THE INVENTION

The present invention generally relates to display units for merchandise and methods of making them, and more particularly to a collapsible display stand which can be packaged, shipped and stored in a substantially flat, collapsed position, and thereafter can be easily set up to display products for consumer purchase.

BACKGROUND OF THE INVENTION

Point of purchase display stands are widely used to exhibit goods in order to attract the attention of potential buyers and encourage them to purchase the displayed items. Such point of purchase display stands can be found in grocery stores, retail stores, supermarkets, drug stores, etc., and are often used during short promotional periods or special occasions, such as the Fourth of July, the Superbowl, and the Holiday seasons. Well-designed point of purchase displays catch the consumer's attention and are usually placed near, on, or next to retail checkout counters at the point of sale. They typically offer an appropriate array and quantity of products, such as chips, puffs, small beverages, dips, and other snacks, and range in design and materials.

Point of purchase displays are often shipped in a disassembled condition, in a flat box containing all of the component parts of the stand. Assembly is often complicated, requiring considerable time, effort and expense. Some displays include metal staples or plastic clips, and almost all require folding and tab locking. Typically they cannot be erected by supermarket personnel, since such employees are typically hired to operate the checkout counters, apply price markings/labels, or stack the goods upon shelves. Indeed, setting up such a display is usually not a simple matter for one who is completely unfamiliar with the task. The sales representative typically must first contact the store and obtain permission to erect the display, and the display must then be erected on site and loaded with products by the sales representative. Notwithstanding, such displays are still useful because they are effective at drawing attention to the products, and the displayed products can be set apart from those on the large shelving units.

Corrugated paperboard storage boxes with automatic erecting bottoms are known, such as disclosed in U.S. Pat. No. 5,887,782 to Mueller. Other corrugated containers are known in which two adjacent side walls are connected to one another by glue tabs having angled folds, such as U.S. Pat. No. 3,258,191 to Mueller, or U.S. Pat. No. 2,220,076 to Carruth. Nevertheless, many display stands have display areas which are very close to the floor, such as U.S. Pat. No. 8,651,298 to Beaty, or U.S. Pat. No. 10,524,589 to Donegan, which is often wasted space since buyers typically do not want to bend down to pick these items off the shelf.

While current point of purchase display stands may be considered satisfactory for their intended purpose, there is a continuing need for improvement. It would therefore be useful to provide a display stand that has a self-deploying or at least partially self-deploying shelf structure which is within easy reach of the buyer, and which also enables rapid set-up from a collapsed configuration to a ready-to-use configuration.

SUMMARY OF THE INVENTION

The present invention comprises a point of purchase display stand having at least one self-deploying shelf, and comprising four serially connected sidewalls. The display stand can be shipped in the flat position and pressed by hand into the erect position by a user without the use of extra tools, and without the need of any specific training or skill. The stand can then also be easily folded back into the flat position for storage, disposal, or recycling.

A first aspect of the invention provides a collapsible display stand including a base section, the base section including four serially connected panels, and at least one self-deploying shelf which is formed upon set-up.

A second aspect of the invention provides a collapsible display stand providing at least one self-deploying auto-shelf, the display stand comprising: a base section having four serially connected wall panels, the base section including: a first wall panel including a first shelving flap and a first bottom strip; a second wall panel including a second shelving flap and a second bottom strip, wherein the right side of the first wall panel is joined to the left side of the second wall panel; a third wall panel including a third shelving flap and a third bottom strip, wherein the right side of the second wall panel is joined to the left side of the third wall panel; a fourth wall panel including a fourth shelving flap and a fourth bottom strip, wherein the right side of the third wall panel is joined to the left side of the fourth wall panel; and a base section side strip joined to the right side of the fourth wall panel, wherein the base section side strip is adapted for adhesive attachment to the left side of the first wall panel, wherein the first, second, third, and fourth shelving flaps form a base section auto-shelf upon set-up, wherein the first, second, third, and fourth bottom strips are folded under the base section to provide support for the base section as it stands upright in the set-up orientation, and wherein the display stand can be packaged, shipped and stored in a substantially flat, collapsed position, and thereafter can be easily set up to display products for consumer purchase.

Another aspect of the invention provides a display stand providing self-deploying auto-shelves, the display stand comprising: a first wall panel including a first shelving flap and a first bottom strip; a second wall panel including a second shelving flap and a second bottom strip, wherein the right side of the first wall panel is joined to the left side of the second wall panel; a third wall panel including a third shelving flap and a third bottom strip, wherein the right side of the second wall panel is joined to the left side of the third wall panel; a fourth wall panel including a fourth shelving flap and a fourth bottom strip, wherein the right side of the third wall panel is joined to the left side of the fourth wall panel; and a base section side strip joined to the right side of the fourth wall panel, wherein the base section side strip is adapted for adhesive attachment to the left side of the first wall panel, wherein the first, second, third, and fourth shelving flaps form a base section auto-shelf upon set-up, and wherein the first, second, third, and fourth bottom strips are folded under the base section to provide support for the base section as it stands upright in the set-up orientation; and a top section having four serially connected double-window panels, the top section including: a first double-window panel including a first middle shelving flap and a first upper shelving flap; a second double-window panel including a second middle shelving flap and a second upper shelving flap, wherein the right side of the first double-window panel is joined to the left side of the second double-window panel; a third double-window panel including a third middle shelving flap and a third upper shelving flap, wherein the right side of the second double-window panel is joined to the left side of the third double-window panel; a fourth double-window panel including a fourth middle shelving flap and a fourth upper shelving flap, wherein the right side of the third double-window panel is joined to the left side of the fourth double-window panel; and a top section side strip joined to the right side of the fourth double-window panel, wherein the top section side strip is adapted for adhesive attachment to the left side of the first double-window panel, wherein the first, second, third, and fourth middle shelving flaps form a top section middle auto-shelf upon set-up, wherein the first, second, third, and fourth upper shelving flaps form a top section upper auto-shelf upon setup, and wherein the display stand can be packaged, shipped and stored in a substantially flat, collapsed position, and thereafter can be easily set up to display products for consumer purchase.

The nature and advantages of the present invention will be more fully appreciated from the following drawings, detailed description, and claims.

BRIEF DESCRIPTION OF THE DRAWINGS

The accompanying drawings illustrate embodiments of the invention and, together with a general description of the invention given above, and the detailed description given below, serve to explain the principles of the invention.

DETAILED DESCRIPTION OF THE INVENTION

Figure 1:
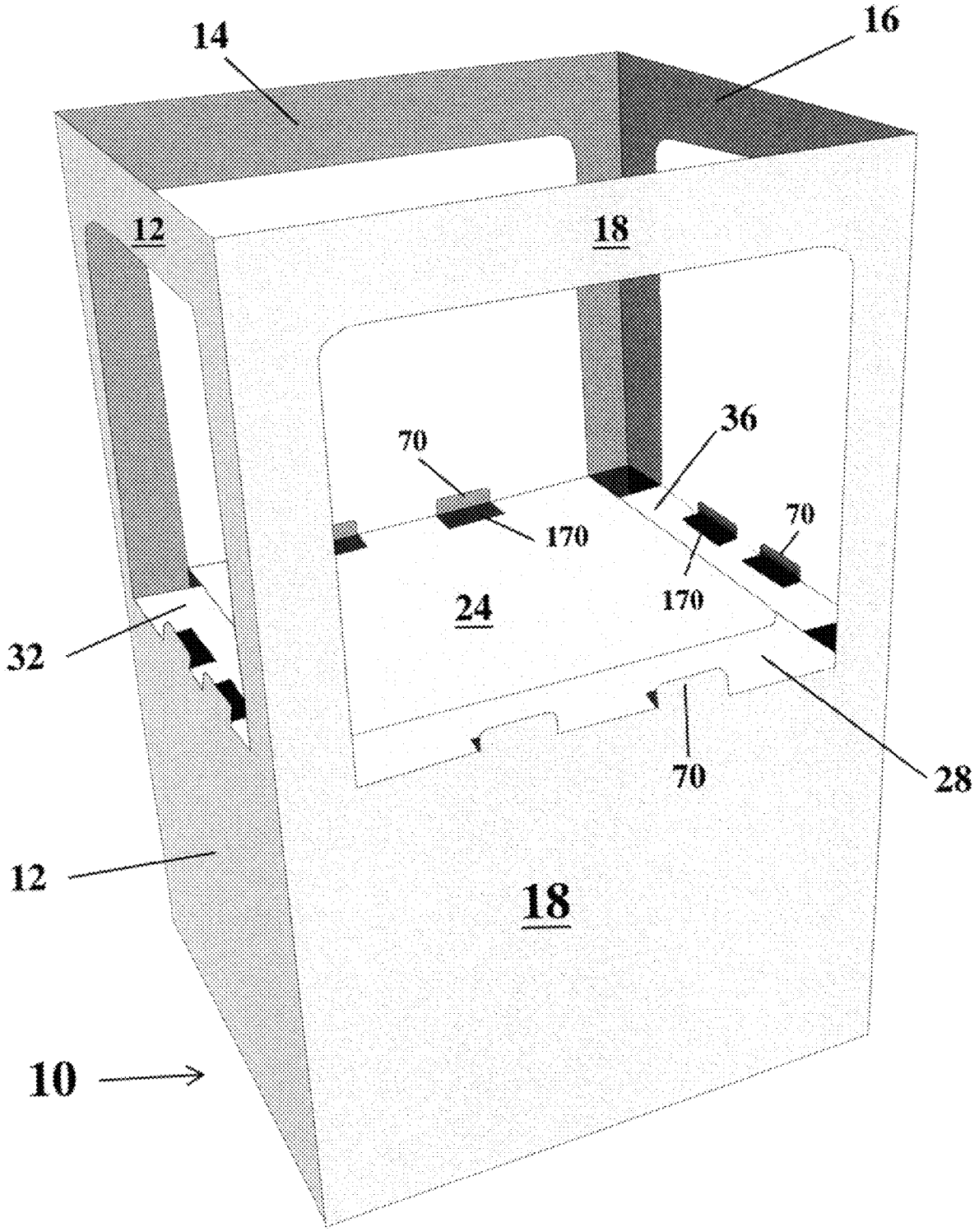
FIG. 1 is a perspective view of the assembled base section upon being set up and ready for use.

A preferred embodiment of the present invention provides a portable, retail point of purchase display stand intended for light to medium weight goods, such as bag products of snack foods, for example chips and puffs. Referring to the figures in general, such a portable display stand preferably includes a base section 10, and also typically includes a top section 60, which can be stacked on top of the base section, as will be described in detail below. A tray section 200 is also disclosed, for attachment to sections 10 and 60 of the display stand, and which is useful for holding jars of dip or salsa. A connector (not shown) for joining two towers together to achieve a larger display is also described. Both sections 10, 60 include at least one auto-shelf, as described herein, and may be articulated between a substantially flattened orientation and an articulated set-up orientation. When assembled, the sections can be positioned in a 3-dimensional configuration to stand upright on the floor, with their auto-shelves fully formed and ready for supporting products.

For purposes of the present discussion, as one is looking at the figures, the term "left" refers to the lefthand side, whereas "right" refers to the right side of the figure; the term "top" refers to the uppermost portion of the figure as one is looking at it, "middle" refers to the center or central portion of the figure, and "bottom" refers to the lowermost portion of the figure. Looking now at FIG. 1, the main shelving unit or base section 10 includes a first wall panel 12, a second wall panel 14, a third wall panel 16, and a fourth wall panel 18, with a self-deploying auto-shelf comprising four successively stacked portions of each wall panel. Each wall panel is pivotably connected to the two wall panels serially adjacent to it, so that the four wall panels 12, 14, 16, 18 of the base section 10 may be articulated between a substantially flattened orientation and an articulated set-up orientation, in which the four wall panels are positioned in a 3-dimensional configuration, such that the base section 10 is now able to stand upright on the floor with the auto-shelf fully formed and ready for supporting items.

Figure 2:
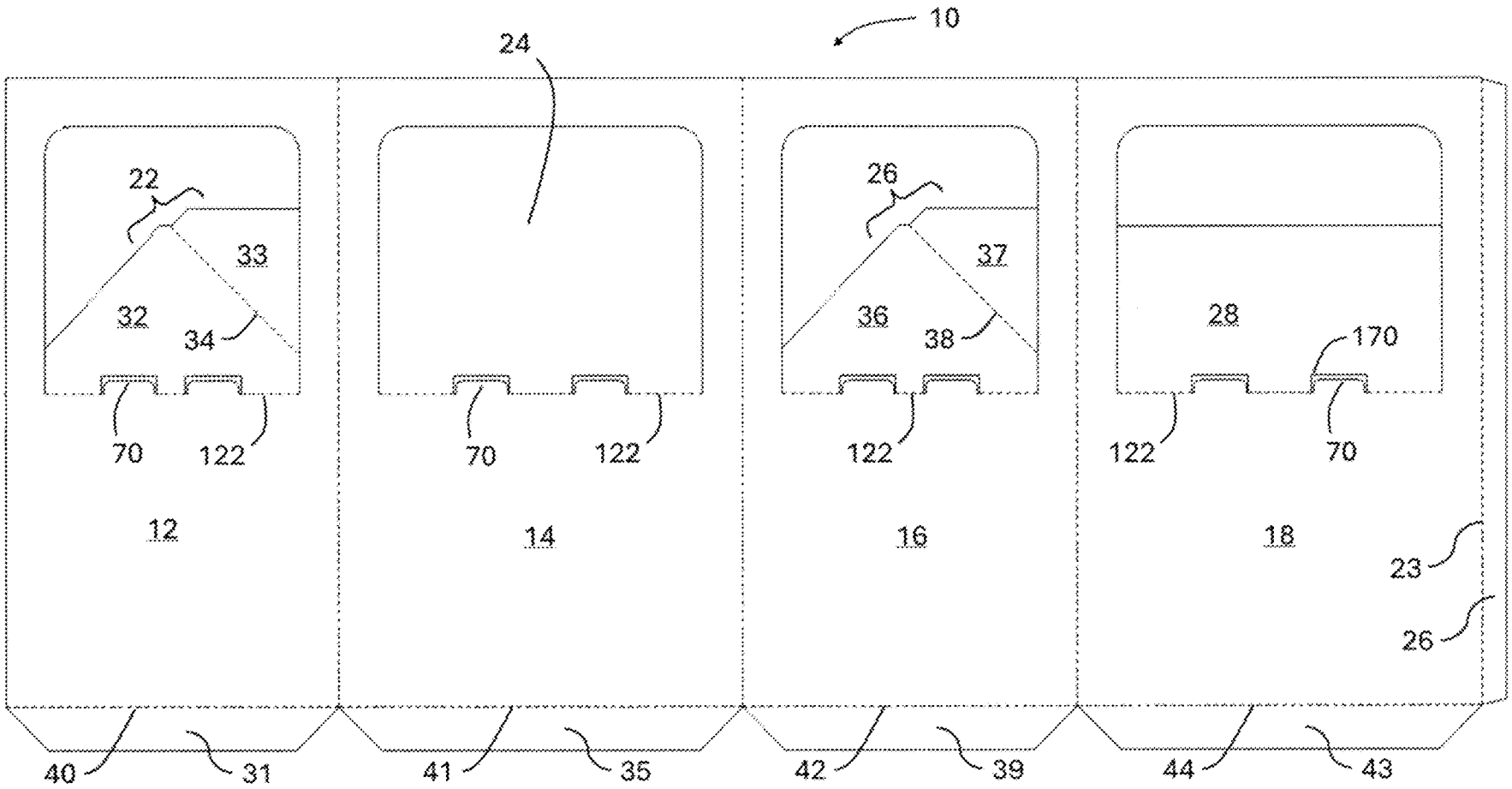
FIG. 2 illustrates a plan view of a blank for forming the base section of the inventive display stand.

FIG. 2 is a plan view of a paperboard blank suitably cut and scored and ready to be assembled, wherein the blank is used for forming the base section 10 of the inventive display stand. The base section 10 has a self-deploying shelf, according to a preferred embodiment of the invention, and includes the first wall panel 12, second wall panel 14, third wall panel 16 and fourth wall panel 18. The right side of the first wall panel 12 is joined by fold line 52 to the left side of the second wall panel 14, the right side of the second wall panel 14 is joined by fold line 54 to the left side of the third wall panel, and the right side of the third wall panel 16 is joined by fold line 56 to the left side of the fourth wall panel 18. Each wall panel 12, 14, 16, 18 includes respective shelving flaps 22, 24, 26, 28.

Specifically, looking at the first wall panel 12 in FIG. 2, it can be appreciated that a first shelving flap 22 (of the first wall panel 12) extends from a shelf fold line 122. The first shelving flap 22 includes a first shelving flap panel 32, and a second shelving flap panel 33, which are joined by fold line 34. A second shelving flap 24 (of the second wall panel 14) is joined by a shelf fold line 122. It can be appreciated from viewing FIG. 2 that the second shelving flap 24, when in this flattened position illustrated, fills the entire window of the second wall panel 14, when flat. The third shelving flap 26 (of the third wall panel 16) has a third shelving flap panel 36 and a fourth shelving flap panel 37 joined by fold line 38. The third shelving flap 26 is joined by a shelf fold line 122. The fourth shelving flap 28 (of the fourth wall panel 18) is also joined by a shelf fold line 122, and fills about half of the window of the fourth wall panel 18, when flat.

Figure 8:
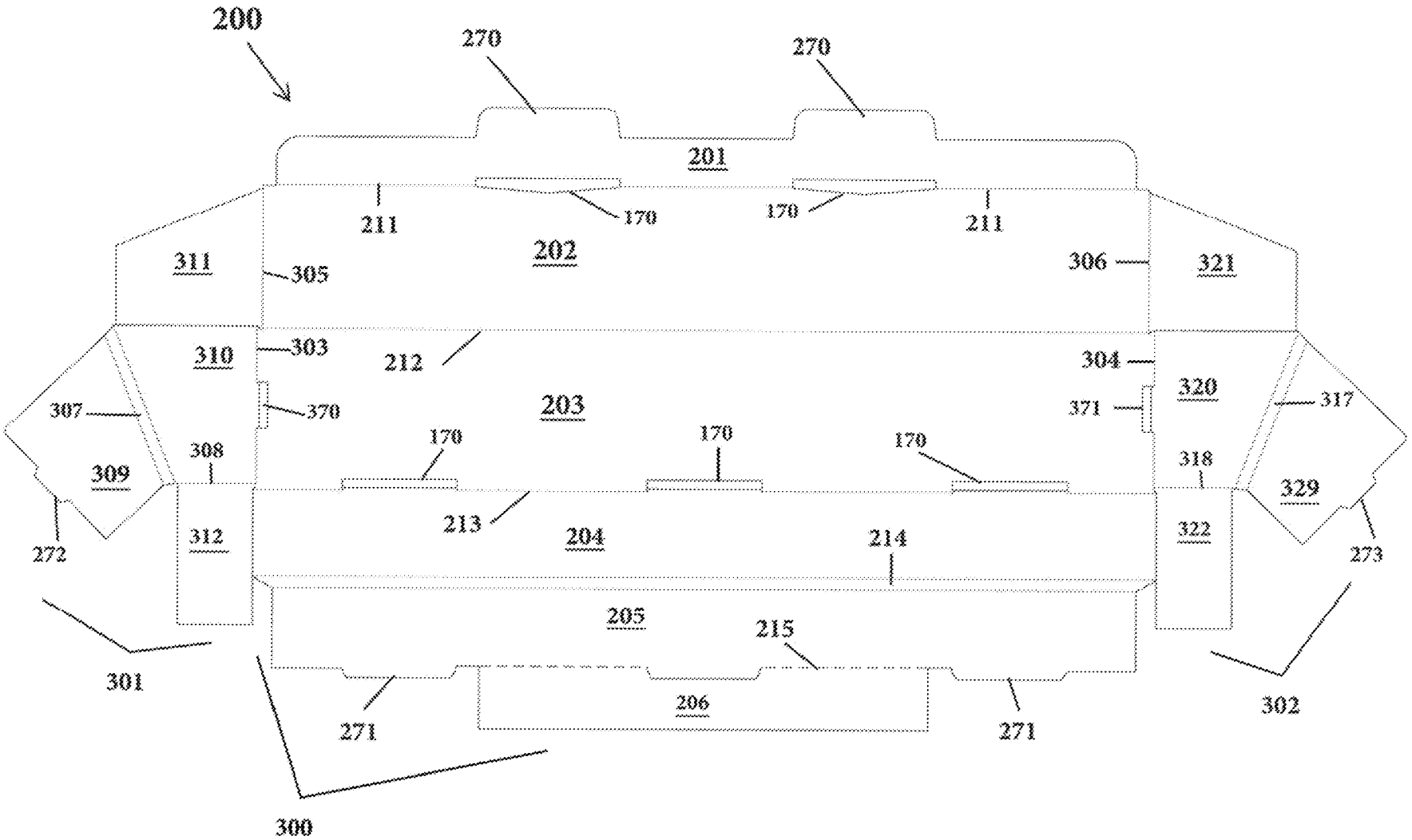
FIG. 8 is a face view of an optional tray component of the inventive display stand, in the form of a paperboard blank suitably cut and scored and ready to be assembled.

Each of the generic shelf fold lines 122 typically includes a pair of tabs 70, which as illustrated are paired with (or as a result of) cutouts or slots 170 made at the root of the shelf fold lines 122. These tabs 70 and their accompanying slots 170 are spaced from one another and extend along the fold line 122. When the display is in use, the tabs 70 can provide an obstacle or barrier to prevent bags of chips or other display items from being pushed off or otherwise sliding off of the shelves. The tabs 70 and their slots 170 can also alleviate bunching of the corrugated material during articulation and set-up of the display. In addition, the slots 170 can provide an attachment for insertion tabs of an optional tray, as illustrated in FIG. 8 and described in more detail below.

The base section 10 also includes a side strip 21, connected by fold line 23 to the right side of the fourth wall panel 18, as well as bottom strips 31, 35, 39 and 43, which are joined by fold lines 40, 41, 42 and 44, respectively, to the bottom sides of their respective wall panels 12, 14, 16 and 18. The bottom strips 31, 35, 39 and 43 can be folded inward, under the standing base section when in the set-up orientation, with the bottom strips 31, 35, 39 and 43, forming strong corners at the bottoms and adding support to the structure as it stands upright on the floor. Side strip 21 is provided for adhesive attachment to either the outer or inner surface of the left side of the first wall panel 12. For purposes of this invention, "adhesive attachment" typically includes gluing as is known in the industry, but can also include attachment by means of staples, stitching, contact cement, spray adhesive, glue stick, Velcro, or other useful attachment means known in the art. Adhesive attachment of the side strips as described herein (see also side strip 71, below) can be done during manufacturing, for example, via a Post/Bobst type folder-gluer, or by other gluing manufacturing systems known in the art, to assist with the ease of assembly in the retail environment.

To form the base section from the blank, the blank 10 is initially folded along fold lines 52, 54, 56 and 23, and the side strip 21 is affixed to the right side of the first wall panel 12. During this folding, shelf fold lines 122 are folded to create the auto-shelf, with the first shelving flap 22 and the third shelving flap 26 being folded under the fourth shelving flap 28, panel 33 being folded back upon panel 32 about fold line 34, such that panel 33 is juxtaposed to the bottom of the fourth shelving flap 28, and with panel 37 being folded back upon panel 36 about fold line 38 such that panel 37 is juxtaposed to the bottom of the second shelving flap 24. The fourth shelving flap 28 is then folded under the second shelving flap 24, such that upon formation of the auto-shelf the second shelving flap 24 is folded up and over the fourth shelving flap 28, which is folded up and over the first shelving flap 22 and the third shelving flap 26, such that the second shelving flap 24 creates the top surface of the auto-shelf.

Figure 3:
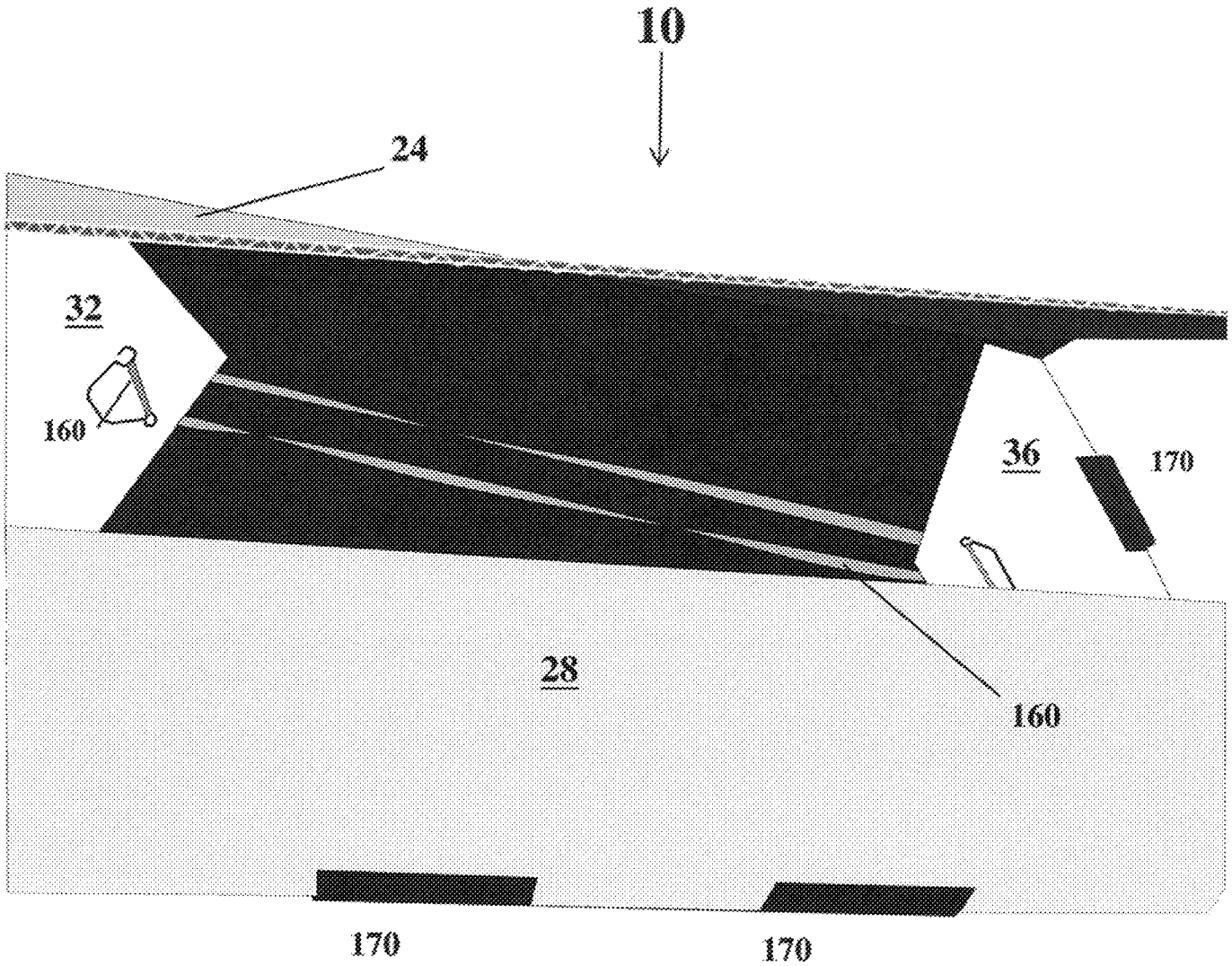
FIG. 3 illustrates the presence of a rubber band holding the panels of the base section flaps together to assist with the easy formation of an "auto-shelf"

To provide greater strength and stability to the auto-shelf, the juxtaposed surfaces of the fourth shelving flap 28 and panel 33 (of the first shelving flap 22) can be adhesively affixed to one another; likewise, the juxtaposed surfaces of the second shelving flap 24 and panel 37 (of the third shelving flap 26) can be adhesively affixed. In addition, as illustrated in FIG. 3, panels 32 and 36 can be joined by a rubber band 160 or other resilient member prior to set up, which aids in ease of set up by pulling the auto-shelf panels and flaps together. The rubber bands would normally be under tension when the display blank is folded in its flat condition, so that the user is aided by the resilient bands in causing the display to assume its folded form or set-up orientation.

Figure 4:
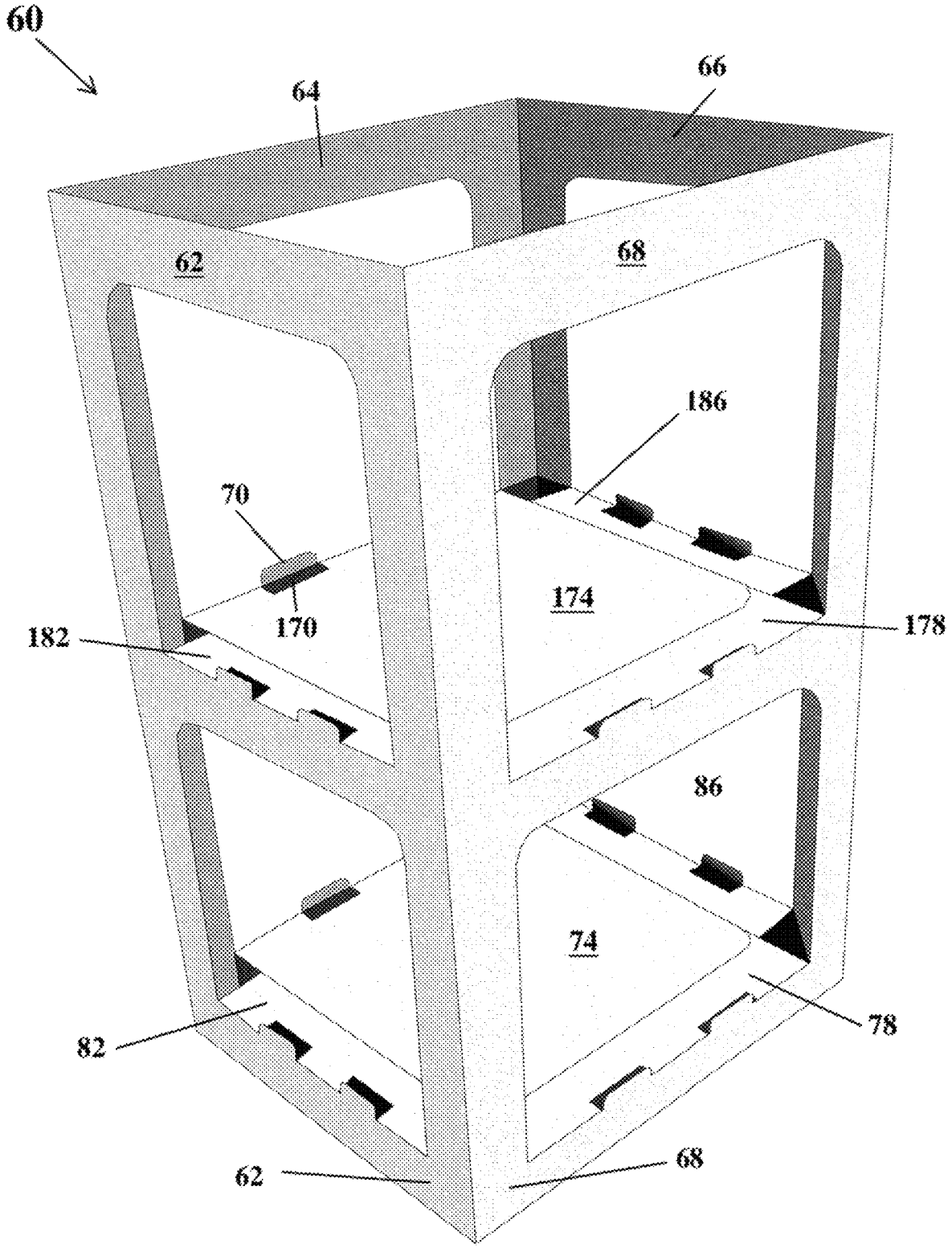
FIG. 4 is a perspective view of the assembled top section upon being set up and ready for use.
Figure 5:
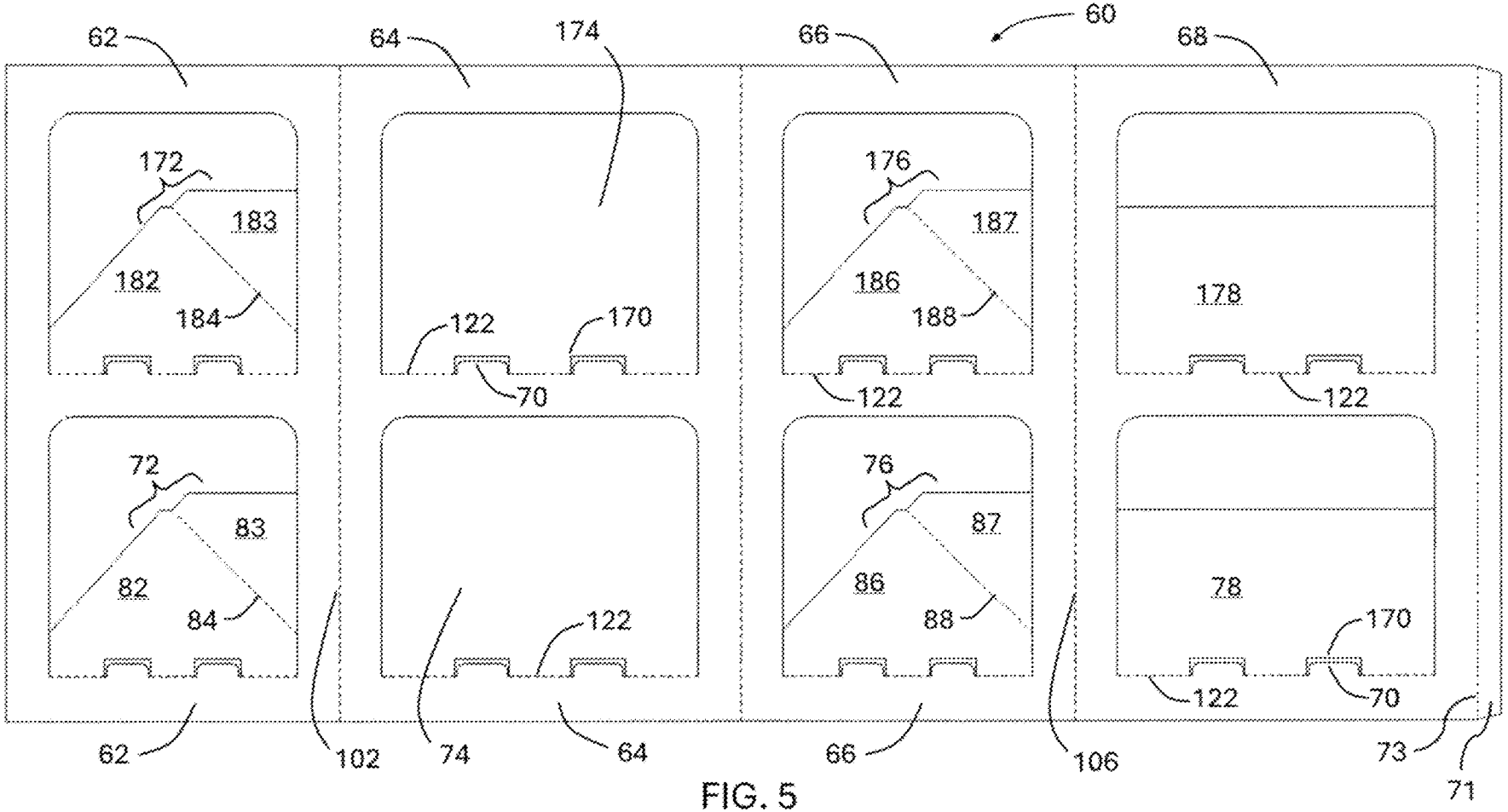
FIG. 5 is a plan view of a blank for forming the top section of the inventive display stand.

As shown in FIGS. 4 and 5, the inventive display stand may also include a top section 60 for vertically extending the stand, for example, so that more goods can be loaded. Also, the base section 10 and the top section 60 together can form a tower (100, see FIG. 6). The top section 60, illustrated in FIG. 4, can include a first double-window panel 62, a second double-window panel 64, a third double-window panel 66, and a fourth double-window panel 68. The double-window panels 62, 64, 66, 68 are analogous to the four wall panels 12, 14, 16, 18 of the base section 10, described above and illustrated in FIGS. 1 and 2; however, rather than a single auto-shelf, each double-window panel includes a pair of auto-shelves, each auto-shelf comprising four successively stacked portions of the double-window panels. Each double-window panel is pivotably connected to the two double-window panels serially adjacent to it, so that the four double-window panels 62, 64, 66, 68 of the top section 60 may be articulated between a substantially flattened orientation and an articulated set-up orientation, positioned in a 3-dimensional configuration. This manner of articulation is similar to that described for the base section 10, above.

Figure 6:
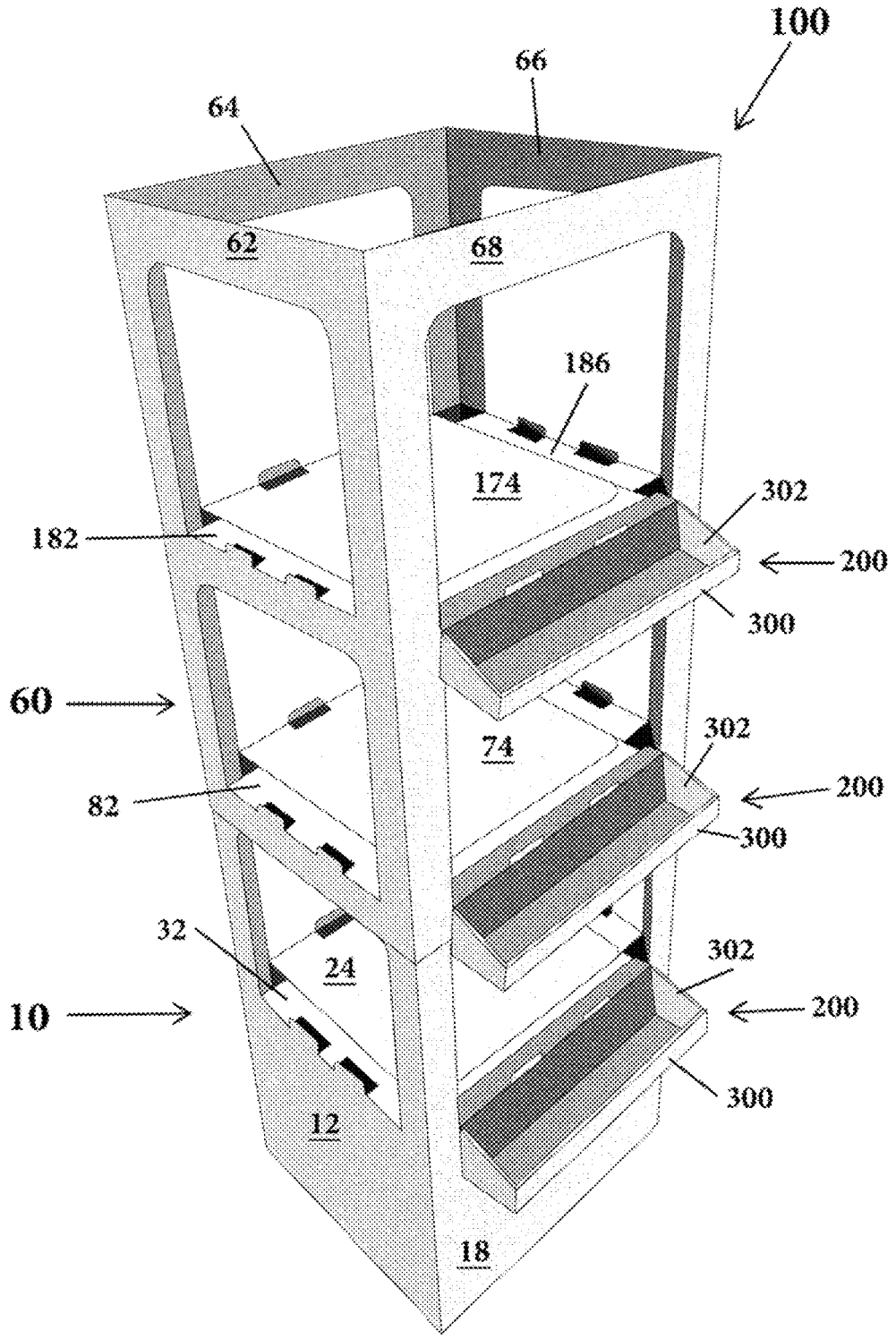
FIG. 6 is a perspective view of the assembled "tower" configuration of the display stand, including the base section and the top section set up, stacked, and ready for use.

When in the set-up orientation as illustrated in FIGS. 1 and 4, the top section 60 is ready to be placed atop the base section 10 to create a tower, as illustrated in FIG. 6. As shown, the outer diameter of the base section 10 can fit within the inner diameter of the top section 60, so that the base section can nest within the top section, with the middle shelf (comprising shelving flaps 74, 78, 178, and 174) resting on the top edge of the base section 10.

FIG. 5 is a plan view of a paperboard blank for forming the top section 60 of the inventive display stand, suitably cut and scored and ready to be assembled. The top section 60 has a pair of (i.e. 2) auto-shelves, which are at least partially self-deploying shelves, according to a preferred embodiment of the invention, and includes the first double-window panel 62, second double-window panel 64, third double-window panel 66, and fourth double-window panel 68. The right side of the first double-window panel 62 is joined by fold line 102 to the left side of the second double-window panel 64, the right side of the second double-window panel 64 is joined by fold line 104 to the left side of the third double-window panel 66, and the right side of the third double-window panel 66 is joined by fold line 106 to the left side of the fourth double-window panel 68. Each double-window panel 62, 64, 66, 68 includes a pair of respective windows and shelving flaps. Specifically, the first double window panel 62 includes middle and upper windows which, when flat, include the middle and upper shelving flaps 72 and 172. Looking at the first double-window panel 62 in FIG. 5, it can be appreciated that their middle and upper shelving flaps 72 and 172 each extend from a shelf fold line 122 at the bottom edge of their respective windows. The middle shelving flap 72 of the first double-window panel 62 includes a first middle shelving flap panel 82 and a second middle shelving flap panel 83, joined by a middle shelving flap fold line 84. Similarly, the upper shelving flap 172 includes a first upper shelving flap panel 182 and a second upper shelving flap panel 183, joined by an upper shelving flap fold line 184.

Similarly to the first double window panel 62, the second double window panel 64 includes middle and upper shelving flaps 74 and 174, the third double window panel 66 includes middle and upper shelving flaps 76 and 176, and the fourth double window panel 68 includes middle and upper shelving flaps 78 and 178. It can be appreciated from viewing FIG. 5 that the middle and upper shelving flaps 74 and 174 of the second double-window panel 64, when in this flattened position illustrated, extend from a shelf fold line 122 and fill their entire respective windows. The middle shelving flap 76 of the third double-window panel 66 includes first and second middle shelving flap panels 86 and 87 joined by fold line 88, and the upper shelving flap 176 of the third double-window panel 66 includes first and second upper shelving flap panels 186 and 187 joined by fold line 188. The middle and upper shelving flaps 78 and 178 of the fourth double-window panel 68 each extend from a shelf fold line 122 at the bottom edge of their respective windows, and when in this flattened position illustrated, fill about half of these windows. As with the base section 10, each of the shelf fold lines 122 of the top section 60 includes at least a pair of tabs 70 and slots 170, which can serve to alleviate bunching of the corrugated material during articulation and set-up of the display, as well as to provide an attachment for an external object such as a tray 200, as illustrated in FIG. 8 and described in more detail below.

To form the top section 60 shown in FIG. 4 from its flattened blank shown in FIG. 5, the free ends of opposing panels 62, 68 of the blank are initially connected/glued together. This process is similar to the formation of the base section 10. Looking again at FIG. 5, the top section 60 also includes a side strip 71, connected by fold line 73 to the right side of the fourth double-window panel 68. Performing a similar function as the side strip 21 of the base section 10, the top section's side strip 71 connects opposing ends of the flattened blank, and specifically provides for adhesive attachment of the right side of the fourth double-window panel 68 to the left side of the first double-window panel 62. This connection begins the set-up orientation, in which the previously flattened, four double-window panels are positioned in a 3-dimensional configuration. When in the set-up orientation as illustrated in FIG. 4, the top section 60 is ready to be placed on top of the formed base section 10 to create a tower as illustrated in FIG. 6, in which the outer diameter of the base section 10 is shown fitting within the inner diameter of the top section 60.

To fully set up the top section, the blank 60 as illustrated in FIG. 5 is initially folded along fold lines 102, 104, 106 and 73, and the side strip 71 is affixed (preferably by adhesive attachment, as described above) to the left side of the first double-window panel 62. During folding, the middle and upper shelving flaps, 72 and 172, of the first double-window panel 62, as well as the middle and upper shelving flaps, 76 and 176, of the third double-window panel 66, are folded under the middle and upper flaps 78, 178, of the fourth double-window panel 68. Specifically, panels 83 and 183 are folded back upon panels 82 and 182 about their respective fold lines 84 and 184, such that panels 83 and 183 are juxtaposed to the respective bottoms of flaps 78 and 178 of the fourth double-window panel 68. In addition, panels 87 and 187 are folded back upon panels 86 and 186 about their respective fold lines 88 and 188, such that panels 87 and 187 are juxtaposed to the respective bottoms of flaps 74 and 174 of the second double-window panel 64. Flaps 78 and 178 of the fourth double-window panel 68 are then folded under their respective flaps 74 and 174, of the second double-window panel 64, such that upon formation of the auto-shelf flaps 74 and 174 of the second double-window panel 64 are folded up and over their respective flaps 78 and 178 of the second double-window panel 64, such that flaps 74 and 174 create the top surfaces of the auto-shelves. This final configuration of the shelves is best seen in FIGS. 4 and 6.

As illustrated in FIG. 6, the base section 10 and the top section 60 can be stacked to form a tower 100, and can include the four wall panels 12, 14, 16, 18 of the base section 10, as well as the four double-window panel 62, 64, 66, 68 of the top section, stacked on top. The tower 100, as illustrated, therefore provides a total of three auto-shelves, 24, 74, 174, stacked one on top of the other, with reinforcing corners and lower walls, which can be set up in the retail environment quickly, saving the retail supplier time and expense as compared to current display items. It is noted here that the inventive display can include wider, "consumer-facing" sides as well as narrow sides. Specifically, panels 14, 18, 64 and 68 can be wider than panels 12, 16, 62 and 66, such that the sides facing the consumer are wider, for shopping ease of access. As a non-limiting example, panels 14 and 18, which comprise the "consumer-facing" panels, can be wider than panels 12 and 16. In such an example, wide panels 14 and 18 can measure between about twenty (20) inches to about twenty-five (24) inches wide, while narrow panels 12 and 16 are typically between about sixteen (16) inches and twenty (20) inches wide. Similarly, wide panels 64 and 68 of the top section can measure between about twenty (20) inches to about twenty-five (24) inches wide, while narrow panels 62 and 66 are typically between about sixteen (16) inches and twenty (20) inches in width. Typically, all panels/sections are about forty (40) inches tall.

In addition to providing the display stand in the form of blanks as illustrated in FIGS. 2 and 5, the sections 10, 60 can also be packaged and shipped in a semi- or pre-formed condition. This pre-formed condition may be preferable for production and shipping, since the Grocery Manufacturers Association (GMA), as part of their efforts to make display shipping and distribution operations smoother and more efficient, recommends a standard pallet display size, often referred to as Knock Down Flat (KDF) displays or GMA pallets. Such pallets are used in North America, as well as worldwide, and standard pallets have a footprint of forty-eight (48) inches×forty (40) inches, while a half-pallet display is forty (40) inches×twenty-four (24) inches. Many retailers have a maximum 60-inch height requirement; however, the sections of the present invention are intended to be about just under forty (40) inches in height, to fit within standard KDF parameters. The combination of the narrow and wide panels, as described above, can fit within the standard forty-eight (48) inch width for a standard KDF pallet size.

Figure 7:
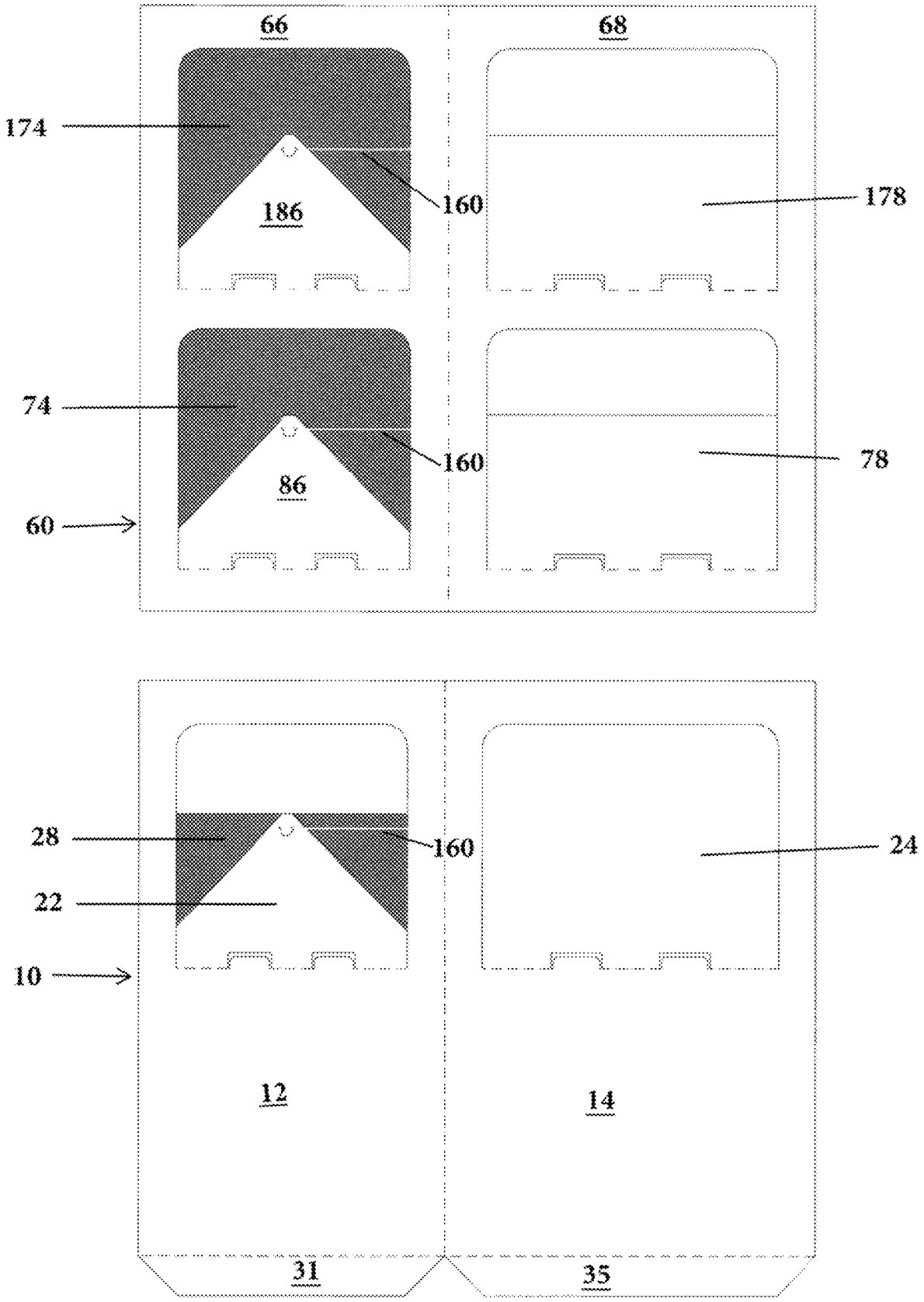
FIG. 7 illustrates the pre-assembled base section and top section, both folded, glued, collapsed and in a substantially flat position, and ready for shipping.

As illustrated in FIG. 7, in order to form the KDF displays, portions of the blanks for the base section 10 and the top section 60, shown in FIGS. 2 and 5, may be preferably glued together (and rubber bands 160 pre-attached) during initial manufacturing and prior to shipping. Specifically, the free ends of the opposing end panel 12 of the base section and panel 62 of the top section can be initially connected/glued together, with their side strips 21, 71 being affixed to the left side of their respective opposite end panels. The pre-assembled base section 10 and top section 60, both folded, glued, and collapsed into a KDF posture, can now be stacked, boxed and shipped prior to final set-up in the retail setting.

The display embodiments illustrated in FIG. 7 and disclosed herein can be packaged and folded flat as a unit, such as in a multi-pack master, to fit within the GMA pallet footprint. Assembly of the inventive display at the retail site can then be accomplished by merely removing one of a plurality of the desired flattened sections from a shipping box or package, and expanding it to use. When assembled and formed into the set-up orientation (see FIGS. 1, 4, and 6), the inventive display typically fits one-quarter of the footprint of a GMA pallet. In addition, if one wanted to put two displays, back-to-back, on the floor for a tower having twice the dimensions, then a connector can be used to join two towers together mechanically. For example, to join the towers, one connector would be required per shelf. Each connector (not shown) can include at least one pair of tabs 70 and slots 170 to provide an attachment means, much like tray 200 can be attached, as illustrated in FIGS. 6 and 8 and described in more detail below.

As illustrated in FIG. 6, the base section 10 and the top section 60, when stacked to form a tower 100, can also include one or more trays 200 attached thereto. A paperboard blank for the tray 200, suitably cut and scored and ready to be assembled, is illustrated in FIG. 8. Each tray 200 can include a set of tabs 270 which extend from an end panel 271, and the end panel 201 can be folded back along fold line 211. This is useful so that the end panel tabs 270 of the folded tray 200 can be inserted into the slots 170 on the shelves of the base section 10 and/or the top section 60 of the tower 100, as best seen in FIG. 6.

To continue folding the blank/tray 200 illustrated in FIG. 8, after initially folding the end panel 201 backwards to expose its tabs 270 for insertion into tower slots 170, tray panel 202 is then folded along fold line 212 towards panel 204. Meanwhile, end panel 206 is folded inward along fold line 215 so that it overlaps with panel 205, and then panels 205/206 (overlapping) are doubled along fold line 214, and the end panel tabs 271 are then tucked into slots 170 located along fold line 213. Panels 206, 205 and 204 thus will create the front portion 300 of the tray 200, as can be seen in FIG. 6. However, prior to tucking the end panel tabs 271 into slots 170 to create the front portion, the left wall 301 and right wall 302 must first be folded together. For the left wall 301, panel 311 is folded inward along fold line 305, panel 310 is folded along line 303, and panel 312 is folded along line 308 and inserted into the front portion 300 of the tray, fitting between panels 204 and 205. Panel 309 is then folded over the top of panel 311, and tab 272 on panel 309 is inserted into slot 370, which is located along fold line 305. Similarly for the right wall 302, panel 321 is folded inward along fold line 306, panel 320 is folded along line 304, and panel 322 is folded along line 318 and inserted into the front portion 300 of the tray between panels 204 and 205. Panel 329 is then folded over the top of panel 321, and tab 273 on panel 329 is inserted into slot 371, which is located along fold line 306.

Once folding of the tray is complete, the end panel tabs 270 of the folded tray 200 can be inserted into the slots 170 on the consumer-facing sides (i.e. the wider sides as described above) of the base section 10 and/or the top section 60 of the tower. The interaction of the end panel tabs 270 of the tray with slots 170 locates and/or secures the tray to the display stand. Specifically, the end panel 201, which has been folded back along fold line 211, allows the end panel tabs 270 of the folded tray 200 to be inserted into the exposed slots 170 present on the shelf fold lines of the base section 10 and/or the top section 60, as described above.

Advantageously, the inventive display is no more expensive than displays previously used, which include the same general type of materials and construction. The unitary blanks from which the different sections of the inventive display can be constructed are typically made from corrugated paperboard material, are lightweight, and collapsible; however, they can also be constructed from corrugated plastic sheets made of suitable polypropylene, polystyrene, polyvinyl chloride, polyethylene, or other material. As a non-limiting example, each section of the display can be formed from a single blank of corrugated paper board, with the flutes of the board providing structural support. Thus, when assembled and erected, the full strength of the material forming the shelf is retained, resulting in a shelf which is as serviceable as shelves which do not have the collapsible feature.

The invention provides one-piece blanks from which a collapsible display can be formed, which blanks can be die-cut, scored, and passed through a folder/gluer by automatic machinery already in common use, in large volume and at low cost. The display stand components are intended to be made of materials that are strong and sturdy in construction, and can be assembled with a minimum number of steps to effect complete assembly and collapse. Assembly can be performed quickly, expeditiously and economically, without the use of special equipment or tools, by a relatively unskilled worker. The outside surface of the display may also be decorated with artwork to provide promotional advertising, or to enhance the overall look and feel of the display.

While the present invention has been illustrated by the description of embodiments and examples thereof, it is not intended to restrict or in any way limit the scope of the appended claims to such details. Additional advantages and modifications will be readily apparent to those skilled in the art. Accordingly, departures may be made from such details without departing from the scope of the invention.

The invention claimed is:

1. A collapsible display stand providing at least one shelving assembly, the display stand comprising:

a) a base section having four serially connected single window panels, the base section including:

i) a first single window panel including a first shelving flap and a first bottom strip;

ii) a second single window panel including a second shelving flap and a second bottom strip, wherein the right side of the first single window panel is joined to the left side of the second single window panel;

iii) a third single window panel including a third shelving flap and a third bottom strip, wherein the right side of the second single window panel is joined to the left side of the third single window panel;

iv) a fourth single window panel including a fourth shelving flap and a fourth bottom strip, wherein the right side of the third single window panel is joined to the left side of the fourth single window panel; and v) a base section side strip joined to the right side of the fourth single window panel, wherein the base section side strip is adapted for adhesive attachment to the left side of the first single window panel, wherein the base section is adapted to transform to a standing, upright position from a flat, collapsed position, the flat, collapsed position including the base section being folded and collapsed for shipping and storage prior to set up, wherein the first shelving flap and the third shelving flap are adapted to be pulled towards one another when the base section is in the flat, collapsed position to transform the base section to the standing, upright position, and wherein said pulling of the first shelving flap and the third shelving flap towards one another positions the first, second, third, and fourth shelving flaps into a stacked relationship to create a base section shelving assembly, and wherein the first, second, third, and fourth bottom strips are folded under the base section to provide support for the display stand when in the standing, upright position.

2. The display stand of claim 1, further comprising:

b) a top section having four serially connected double-window panels, the top section including:

i) a first double-window panel including a first middle shelving flap and a first upper shelving flap;

ii) a second double-window panel including a second middle shelving flap and a second upper shelving flap, wherein the right side of the first double-window panel is joined to the left side of the second double-window panel;

iii) a third double-window panel including a third middle shelving flap and a third upper shelving flap, wherein the right side of the second double-window panel is joined to the left side of the third double-window panel;

iv) a fourth double-window panel including a fourth middle shelving flap and a fourth upper shelving flap, wherein the right side of the third double-window panel is joined to the left side of the fourth double-window panel; and v) a top section side strip joined to the right side of the fourth double-window panel, wherein the top section side strip is adapted for adhesive attachment to the left side of the first double-window panel, wherein the top section is adapted to transform to a standing, upright position from a flat, collapsed position, the flat collapsed position including the top section being folded and collapsed for shipping and storage prior to set up, wherein the first middle shelving flap and the third middle shelving flap are adapted to be pulled towards one another when the top section is in the flat, collapsed position, and wherein the first upper shelving flap and the third upper shelving flap are adapted to be pulled towards one another when the top section is in the flat, collapsed position to transform the top section to the standing, upright position, and wherein said pulling of the first middle shelving flap and the third middle shelving flap towards one another positions the first, second, third, and fourth middle shelving flaps into a stacked relationship with one another to create a middle shelving assembly, and wherein said pulling of the first upper shelving flap and the third upper shelving flap towards one another positions the first, second, third and fourth upper shelving flaps into a stacked relationship with one another to create an upper shelving assembly, and wherein the top section is adapted to be positioned on top of the base section, with the outer diameter of the base section nesting within the inner diameter of the top section when they are in the standing, upright position.

3. The display stand of claim 2, wherein a plurality of the base sections and top sections are packaged and shipped together as a unit.

4. The display stand of claim 2, further comprising at least one tray section for attachment to the periphery of the base section, wherein each of the at least one tray section includes an end panel having a set of end panel tabs which extend therefrom, wherein the end panel tabs are adapted to be inserted into slots located on the first, second, third and fourth shelving flaps of the base section.

5. The display stand of claim 4, wherein each of the base section, the top section and the at least one tray section is formed from a single contiguous blank of material fabricated from corrugated paperboard, paper, paperboard, or corrugated plastic sheets.

6. The display stand of claim 1, wherein the first shelving flap and the third shelving flap are adapted to be connected by a rubber band or other resilient member for assistance in pulling the first shelving flap and the third shelving flap towards one another to transform the base section to the standing, upright position.

7. A display stand providing a plurality of shelving assemblies, the display stand comprising:

a) a base section having four serially connected single window panels, the base section including:

i) a first single window panel including a first shelving flap and a first bottom strip;

ii) a second single window panel including a second shelving flap and a second bottom strip, wherein the right side of the first single window panel is joined to the left side of the second single window panel;

iii) a third single window panel including a third shelving flap and a third bottom strip, wherein the right side of the second single window panel is joined to the left side of the third single window panel;

iv) a fourth single window panel including a fourth shelving flap and a fourth bottom strip, wherein the right side of the third single window panel is joined to the left side of the fourth single window panel; and v) a base section side strip joined to the right side of the fourth single window panel, wherein the base section side strip is adapted for adhesive attachment to the left side of the first single window panel, wherein the base section is adapted to transform to a standing, upright position from a flat, collapsed position, the flat collapsed position including the base section being folded and collapsed for shipping and storage prior to set up, wherein the first shelving flap and the third shelving flap are adapted to be pulled towards one another when the base section is in the flat, collapsed position to transform the base section to the standing, upright position, and wherein said pulling of the first shelving flap and the third shelving flap towards one another positions the first, second, third, and fourth shelving flaps into a stacked relationship to create a base section shelving assembly, and wherein the first, second, third, and fourth bottom strips are folded under the base section to provide support for the display stand when in the standing, upright position; and b) a top section having four serially connected double-window panels, the top section including:

i) a first double-window panel including a first middle shelving flap and a first upper shelving flap;

ii) a second double-window panel including a second middle shelving flap and a second upper shelving flap, wherein the right side of the first double-window panel is joined to the left side of the second double-window panel;

iii) a third double-window panel including a third middle shelving flap and a third upper shelving flap, wherein the right side of the second double-window panel is joined to the left side of the third double-window panel;

iv) a fourth double-window panel including a fourth middle shelving flap and a fourth upper shelving flap, wherein the right side of the third double-window panel is joined to the left side of the fourth double-window panel; and v) a top section side strip joined to the right side of the fourth double-window panel, wherein the top section side strip is adapted for adhesive attachment to the left side of the first double-window panel, wherein the top section is adapted to transform to a standing, upright position from a flat, collapsed position, the flat collapsed position including the top section being folded and collapsed for shipping and storage prior to set up, wherein the first middle shelving flap and the third middle shelving flap are adapted to be pulled towards one another, and wherein the first upper shelving flap and the third upper shelving flap are adapted to be pulled towards one another when the top section is in the flat, collapsed position to transform the top section to the standing, upright position, and wherein said pulling of the first middle shelving flap and the third middle shelving flap towards one another positions the first, second, third, and fourth middle shelving flaps into a stacked relationship with one another to create a middle shelving assembly, and wherein said pulling of the first upper shelving flap and the third upper shelving flap towards one another positions the first, second, third and fourth upper shelving flaps into a stacked relationship with one another to create an upper shelving assembly, and wherein the top section is adapted to be positioned on top of the base section, with the outer diameter of the base section nesting within the inner diameter of the top section when they are in the standing, upright position.

8. The display stand of claim 7, further comprising at least one tray section for attachment to the periphery of the display stand, wherein each of the at least one tray section includes an end panel having a set of end panel tabs which extend therefrom, wherein the end panel tabs are adapted to be inserted into slots located on the shelving flaps of the base section and the top section.

9. The display stand of claim 8, wherein each of the base section, the top section and the at least one tray section is formed from a single contiguous blank of material fabricated from corrugated paperboard, paper, paperboard, or corrugated plastic sheets.

10. The display stand of claim 7, wherein the first shelving flap and the third shelving flap are adapted to be connected by a rubber band or other resilient member for assistance in pulling the first shelving flap and the third shelving flap towards one another, and wherein the first middle shelving flap and the third middle shelving flap are adapted to be connected by a rubber band or other resilient member for assistance in pulling them towards one another, and wherein the first upper shelving flap and the third upper shelving flap are adapted to be connected by a rubber band or other resilient member for assistance in pulling them towards one another to transform the base section and the top section to the standing, upright position.

* * * * *